United States Patent [19]

Pinto et al.

[11] 4,061,081

[45] Dec. 6, 1977

[54] MACHINE FOR ERECTING FOLDED CARTONS

[75] Inventors: Albert A. Pinto, White Plains, N.Y.; Alexander J. Stanley, Milltown, N.J.

[73] Assignee: Nabisco, Inc., East Hanover, N.J.

[21] Appl. No.: 674,375

[22] Filed: Apr. 7, 1976

[51] Int. Cl.[2] ..... B31B 1/76

[52] U.S. Cl. ..... 93/53 SD

[58] Field of Search ..... 93/53 BF, 53 SD, 53 R; 53/186

[56] References Cited

U.S. PATENT DOCUMENTS

| | | | |
|---|---|---|---|
| 3,217,463 | 11/1965 | Stannard et al. | 93/53 BF X |
| 3,273,471 | 9/1966 | Dollheimer | 93/53 SD |
| 3,533,333 | 10/1970 | McIntyre | 93/53 SD |
| 3,613,525 | 10/1971 | Lense et al. | 93/53 SD |
| 3,768,381 | 10/1973 | Kopp | 93/53 SD X |
| 3,848,519 | 11/1974 | Ganz | 93/53 SD |

FOREIGN PATENT DOCUMENTS

| | | | |
|---|---|---|---|
| 1,124,799 | 3/1962 | Germany | 93/53 SD |

*Primary Examiner*—Roy Lake
*Assistant Examiner*—Paul A. Bell
*Attorney, Agent, or Firm*—Gerald Durstewitz; Paul E. O'Donnell, Jr.

[57] ABSTRACT

Folded cartons are individually removed from a storage magazine by a vacuum head having a large area surface in which are formed plural vacuum ports having a large combined area. The vacuum ports are connected to a low pressure, high volume vacuum exhauster. The head carries the carton to a point over a conveyor. On each side of the conveyor, a pair of suction cups are carried by an assembly mounted for combined vertical and horizontal movement. The suction cups are connected to a high pressure, low volume vacuum pump. They are moved upwardly to grip a panel on the lower surface of the folded carton and moved downwardly to open the carton and draw it into a bucket on the conveyor.

3 Claims, 7 Drawing Figures

MACHINE FOR ERECTING FOLDED CARTONS

BACKGROUND OF THE INVENTION

The present invention relates to carton erecting machines, and, more particularly, to such machines which employ vacuum devices for gripping both surfaces of the folded carton and a mechanism for moving one of the vacuum devices with respect to the other to pull the carton into an opened condition.

Folded cartons are formed from flat carton blanks having score lines defining the individual panels of the carton and having a narrow tapered strip or edge on one end for glueing. The blank is bent at each of score lines defining the side edges of the panels, and the tapered strip is glued to the edge of the panel on the opposite end of the blank. The folded carton, when properly formed, is a tubular parallelogram which flattens out under the weight of a stack of cartons but tends to spring open again when pressure is removed. Such cartons are easy to open, and if made of board of uniform thickness and stiffness, can be erected by the conventional prior art machines without incident.

In actual practice, a significant percentage of folded cartons are not properly and uniformly made and the prior art machines are not capable of effectively erecting such imperfect cartons. The machine therefore malfunctions causing a temporary shut down of the line while the machine is cleared of faulty cartons or readjusted to accomodate cartons made of different board.

One common fault in carton construction is failure to bend the blank along all appropriate score lines as it is formed. This makes the carton difficult to open since the opening mechanism must supply enough force to bend the carton along that score line. A second common fault is the partial glueing together of the internal surfaces of the carton caused by misalignment of the glueing mechanism or the application of an excessive amount of glue. In order to open these cartons, this glue bond must be broken by the erecting mechanism. A third common problem is warpage of the cartons due to improper storage or construction. Warpage has two adverse effects. When it bends the carton transversely to the score lines, it makes opening of the carton difficult, and it changes the position of the surface of the end carton in the magazine causing problems in removing the carton from the magazine.

Another factor which causes many prior art carton erecting machines to malfunction is a variation in the stiffness of the cartons due to a change in the board from which they are formed. Where the carton at the open end of a magazine is held in by lips which engage opposite edges of the carton, and where the magazine is oriented so that the weight of the cartons act against the end carton, the end carton bends in an outward arc between the two retaining lips. The extent of this deflection is dependent upon the stiffness of the board from which the cartons are made. The prior art erecting machines using this type of magazine must be adjusted according to the extent of the deflection and therefore a variation in the stiffness of the cartons causes the machine to malfunction and requires readjustment.

SUMMARY OF THE INVENTION

It is the object of the present invention to provide an improved machine for erecting cartons which routinely handles imperfect cartons without malfunction or adjustment.

The foregoing object is generally accomplished by providing apparatus for erecting folded cartons which includes a vacuum head for removing the end folded cartons from a magazine and moving it to a position over a conveyer, the head having a large port area connected to a low pressure high volume vacuum exhauster, and carton opening means having a plurality of spaced vacuum ports of small area connected to a high pressure low volume vacuum pump, the opening means being moveable into contact with the carton held by the head and then toward the conveyor to pull open the carton and place it on the conveyor.

BRIEF DESCRIPTION OF THE DRAWING

A preferred embodiment of the invention has been chosen for purposes of illustration and description, and is shown in the accompanying drawing, forming a part of the specification, wherein.

DETAILED DESCRIPTION OF THE PREFERRED EMBODIMENT

Figure 2:
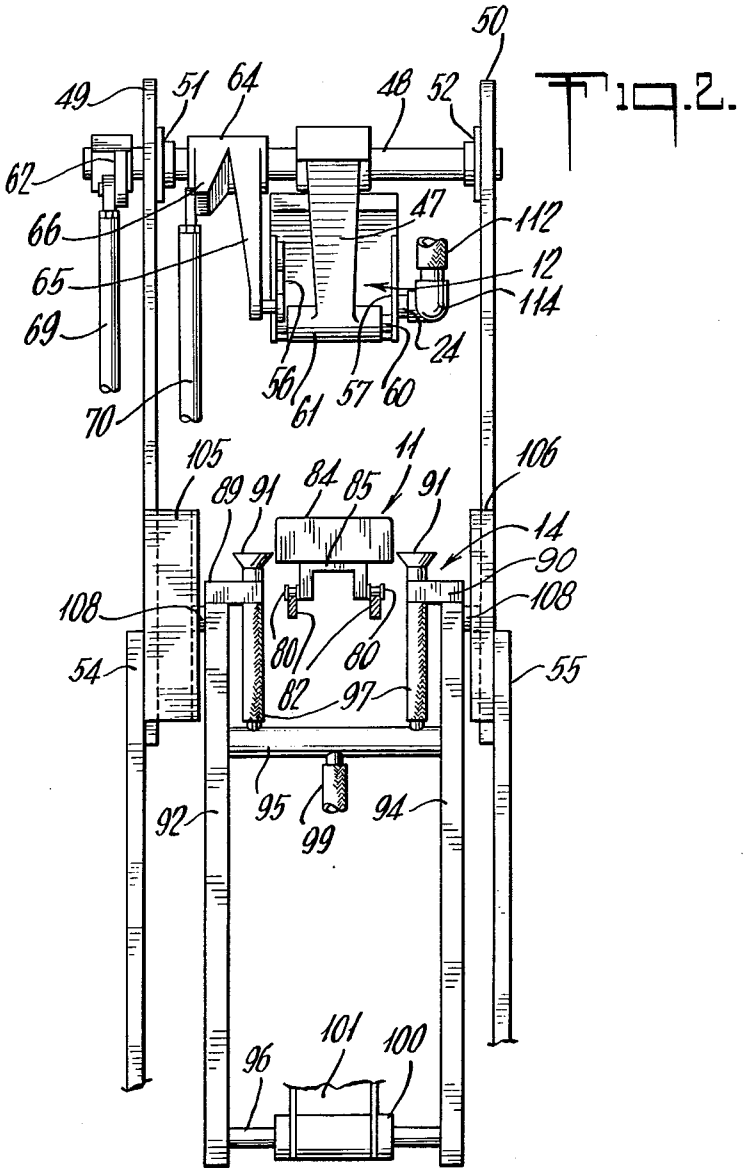
FIG. 2 is a right side elevational view, partly in section, of the machine shown in FIG. 1.

Referring now to the drawings in detail, there is shown a machine for erecting cartons in accordance with the present invention which generally includes a magazine 10 for supplying folded cartons A, a conveyor 11 for carrying erected cartons to a loading station, a vacuum head 12 for removing cartons from the magazine and positioning them over the conveyor, and a vacuum assembly 14 for cooperating with the head 12 to open the cartons and move the open carton onto the conveyor 11.

Figure 3:
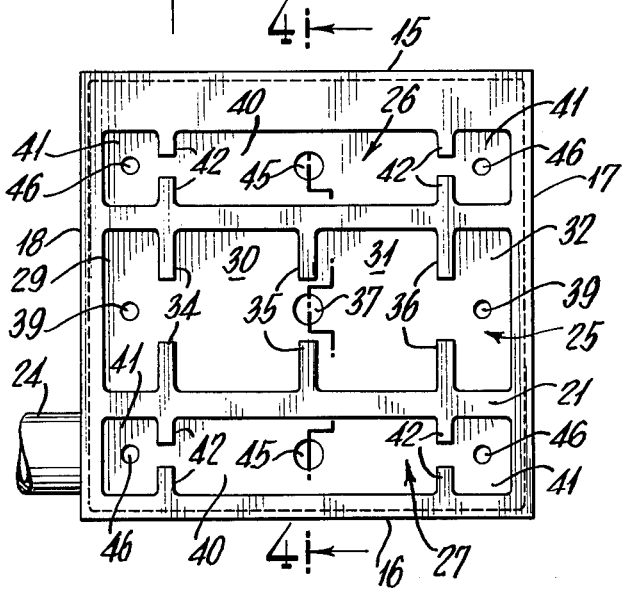
FIG. 3 is a view taken along line 3—3 on FIG. 1 showing the vacuum port arrangement of the vacuum head.
Figure 4:
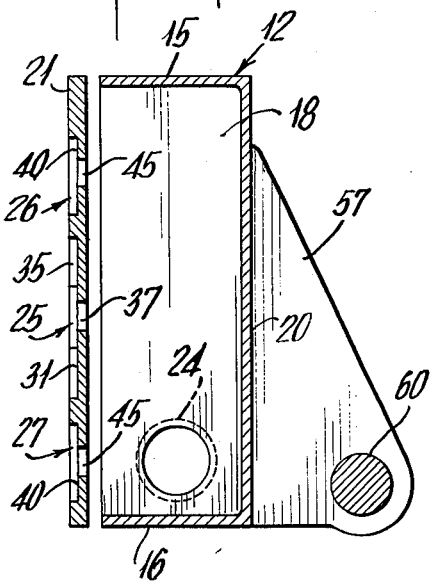
FIG. 4 is a sectional view taken along line 4—4 on FIG. 3.

As shown in FIGS. 3 and 4, the head 12 is a box-like structure having end walls 15, 16 and side walls 17, 18 arranged to form a rectangular tube, a solid wall 20 closing one end of the tube, and a ported wall 21 closing the other end of the tube. These six walls define a chamber 22 and a tubular fitting 24 is provided in the side wall 18 to provide communication with the chamber 22. The ported wall 21 is formed with a wide elongated central recess 25 and two narrow elongated recesses 26 and 27 on either side thereof. The central recess 25 is divided into four portions 29, 30, 31 and 32 positioned side by side and separated by pairs of wall segments 34, 35 and 36. The two central recess portions 30 and 31 are larger in area than the end portions 29 and 32. The recess 25 is placed in communication with the chamber 22 by means of a bore 37 positioned between the wall segments 35 and a pair of bores 39 positioned centrally in the recess portions 29 and 32.

Figure 1:
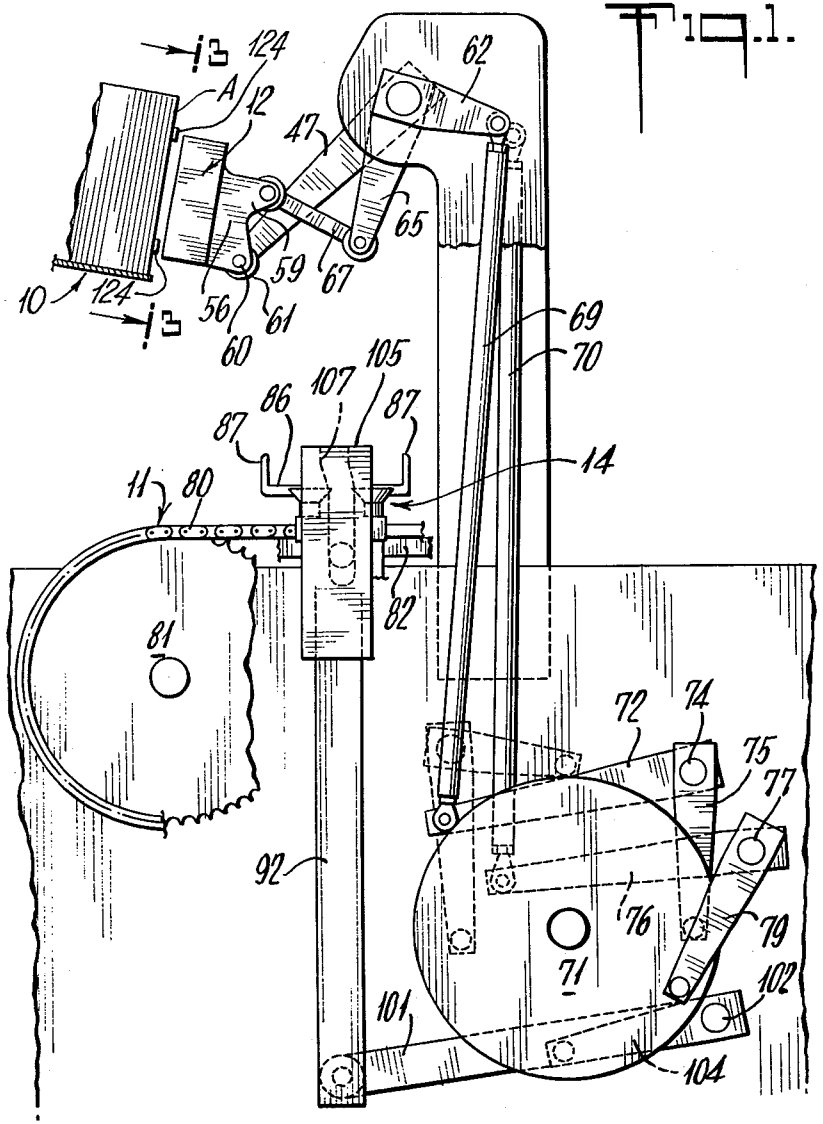
FIG. 1 is a front elevational view of a machine for erecting folded cartons in accordance with the present invention.

The head 12 is mounted on an arm 47 which is rigidly clamped to a shaft 48. The shaft 48 is pivotally supported between two vertical frame members 49 and 50 in bearings 51 and 52. The members 49, 50 are secured to and extend upwardly from the front and rear main frame plates 54, 55 of the machine. The head 12 is provided with a pair of flange plates 56, 57 secured to the wall 20 and extending parallel to the walls 17 and 18 respectively. The flange plate 57 is generally triangular, as shown in FIG. 4, and tapers toward the wall 20 from its lower edge which is parallel with the wall 16. As shown in FIG. 1, the flange plate 56 is similar to the plate 57 with the addition of a protrusion 59 adjacent its upper end extending away from the head 12. A shaft 60 extends between the flange plates 56, 57 and is journalled in a tubular formation 61 formed on the end of the arm 47. The shaft is rotated in the bearings 51 and 52 by means of an arm 62 clamped to the end of the shaft. The head 12 is pivoted about the shaft 60 by means of an arrangement including a formation 64 pivotally mounted on the shaft 60, a pair of arms 65 and 66 extending from the formation 64 and a link 67 connecting the arm 65 to the protrusion 59 on the flange plate 56.

The arms 62 and 66 are connected to rods 69 and 70 extending downwardly to lever arrangements operated by a cam wheel 71. The lower end of rod 69 is connected to an arm 72 mounted to a journalled shaft 74. A cam follower lever 75 is mounted to the rod 74 and engages a cam track on the wheel 71 to rotate the arm 62 and the rod 48. The lower end of the rod 70 is similarly connected to an arm 76 mounted to a journalled shaft 77. The shaft 77 is rotated by a cam follower lever 79 mounted thereon and engaging a second cam track on the wheel 71.

The conveyor 11 is of conventional construction comprising a pair of endless chains 80 extending between sprockets 81 (one of which is shown). The upper flight of the chains ride on supporting rails 82 and trough shaped buckets 84 have a floor 86 and two die walls 87 which extend transversely with respect to the chains.

Figure 5:
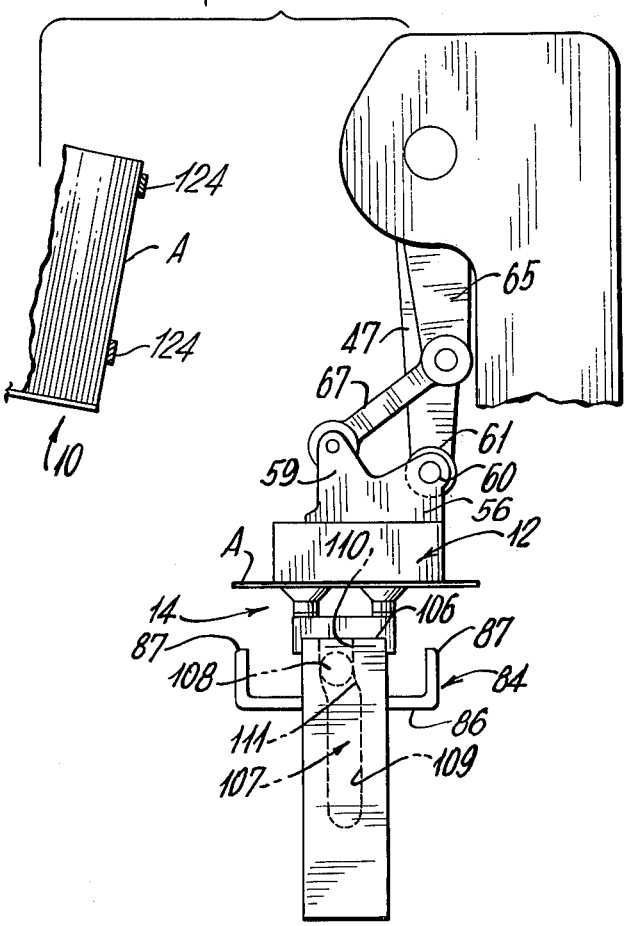
FIG. 5 is a view similar to FIG. 1 showing the position of the major elements thereof at a subsequent time.
Figure 6:
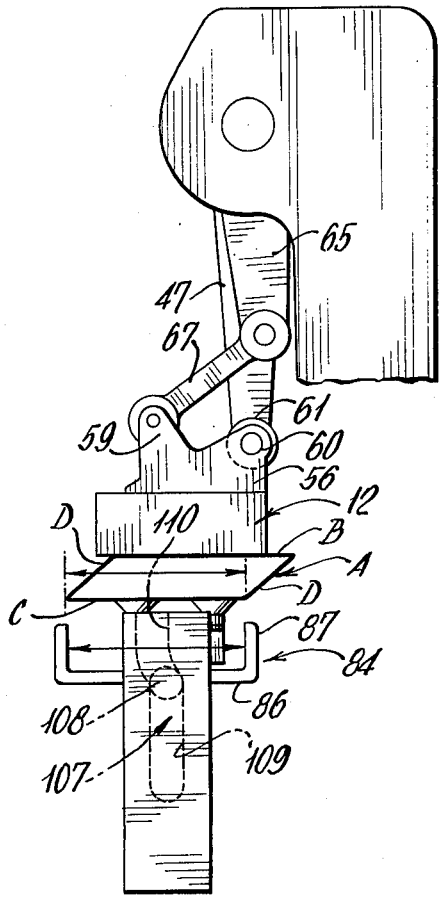
FIG. 6 is a view similar to FIG. 5 showing the next step in the operation of the machine.

The vacuum assembly 14 includes two horizontal plates 89 and 90 positioned on each side of the conveyor 11, a pair of suction cups 91 mounted on each plate 89 & 90, and a vertical bar 92 & 94 extending downwardly from the plates 89 and 90 respectively. The bars 92 and 94 are interconnected by two cross shafts 95 and 96. An air hose 97 extends from each of the plates 89 and 90 down to the upper cross shaft 95. Each of the plates 89 and 90 is internally bored to interconnect the suction cups 91 thereon to the interior of the hose 97. The shaft 95 is also internally bored to interconnect the hoses 97 with an air hose 99 connected to the shaft to interconnect the tub 99 with the suction cups 91. The lower cross shaft 96 is journalled in a cylindrical formation 100 (FIG. 2) carried on the end of a lever arm 101 that is mounted on a pivoted shaft 102. A cam follower arm 104 is mounted on the shaft 102 and engages a cam track on the wheel 71 to move the assembly 14 vertically. Two vertically oriented cam plates 105, 106 are mounted to the inner faces of the frame members 54 and 55. As best shown in FIGS. 5 and 6, the cam plates are provided with cam grooves 107 each of which has a long lower vertical section 109, a short upper vertical section 110 offset from the lower section, and a central section 111 interconnecting the vertical sections. Cam following rollers 108 are mounted to the bars 92 and 94 and extend into the cam grooves 107 to guide the assembly 14.

The chamber 22 within the head 12 is connected to a low pressure high volume air exhauster through an air hose 112 and a pipe elbow 114 connected to the fitting 24. In the preferred embodiment, the ported wall 21 has an area of about 60 square inches, and the combined area of the port recesses 25, 26 and 27 is about 40 square inches. The air exhauster used in the preferred embodiment produces an air flow through the ported wall 21 of 60 cubic feet per minute under 3 pounds per square inch suction.

The suction cups 91 of the vacuum assembly 14 are connected to a high pressure low volume vacuum pump through the hose 99. In the preferred embodiment the suction cups 91 each have a diameter of about 1 5/16 inches and the vacuum pump produces a total air flow through the four suction cups of approximately 10 cubic feet per minute under a suction of 12 pounds per square inch.

Figure 7:
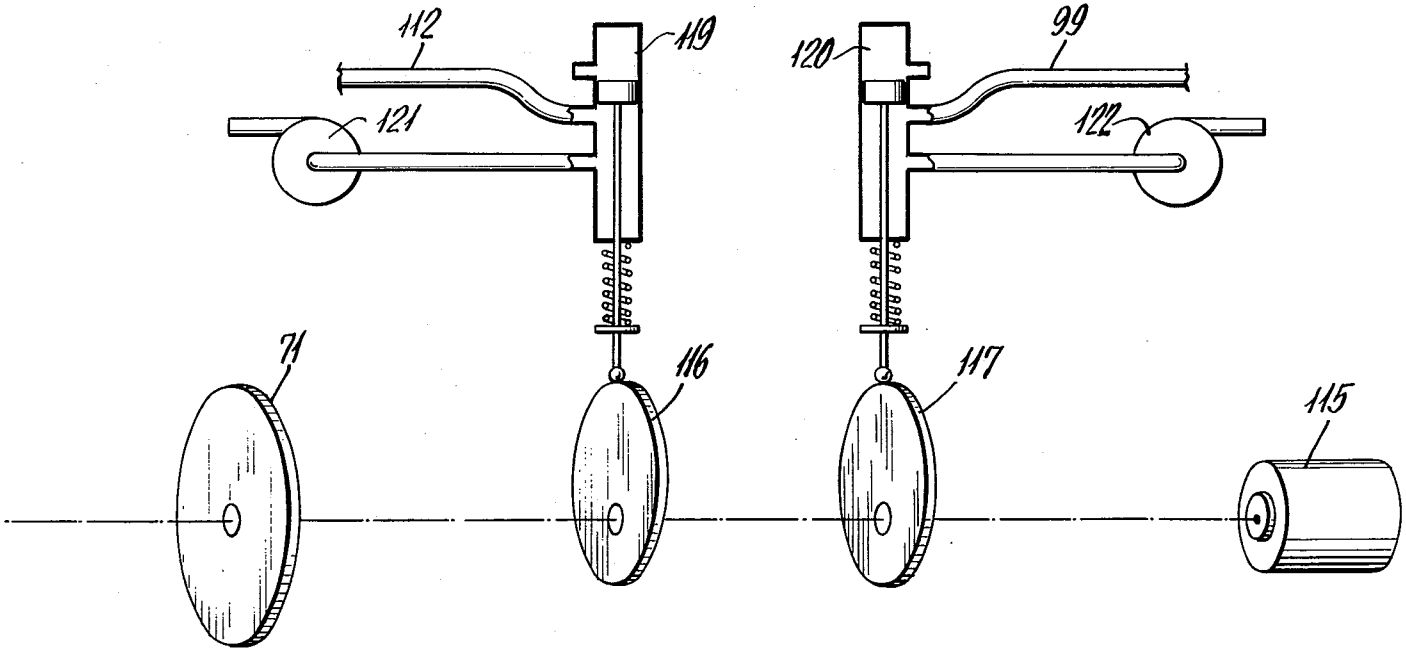
FIG. 7 is a schematic illustration of a representative vacuum system for producing and controlling the two suction air flows utilized by the present invention.

Referring to FIG. 7, the cam wheel 71 is continuously driven by an electric motor 115. A pair of cam wheels 116, 117 are also driven by the motor for operating a pair of air valves 119 and 120. The valves 119 and 120 are respectively connected between the air hose 112 and the air exhauster 121 and between the air hose 99 and the vacuum pump 122. The valves each have two positions, one in which the suction source (exhauster 121 and pump 122) is connected to the air hose (112 and 99 respectively), and the other in which the air hoses are vented to atmosphere. The exhauster 121 and the pump 122 are electrically driven by a motor provided within each unit. The sprockets 81 of the conveyor 11 is driven in steps in synchronism with the cam wheel.

In the beginning of a cycle of operation, rotation of the cam wheel 71 causes the rod 69 to be pulled downwardly and the rod 70 to be pushed upwardly at the same time. The arm 47 therefore rotates clockwise (FIG. 1) and the arm 65 counterclockwise to move the head 12 into the position shown in FIG. 1. As the head moves toward the end of the magazine 10, the air valve 119 is opened to connect the head 12 with the high volume low pressure air exhauster. The high volume of air flowing through the ports in the wall 21 of the head 12 will draw a carton A from the end of the magazine when it is still up to ¾ inch away. The motion of the head continues until it presses against the end of the carton stack to insure there is no difficulty in removing warped cartons or cartons which because of having greater stiffness deflect outwardly to a lesser extent than normal. The cartons A are loaded into the magazine 10 with their open ends at the front and rear sides of the magazine as will be evident from FIG. 6. The end carton is retained in the magazine by tabs 124 which engage the edges of the open ends of the carton. The head 12 is narrower than the folded carton blank and therefore fits between the tabs on the front and back sides of the magazine.

After the head engages the end of the carton stock, the rods 69 and 70 swing it down into the position shown in FIG. 5 with the carton blank A positioned vertically above a conveyor bucket 84. At the same time, the lever arm 101 is moving the vacuum assembly 14 upwardly to bring the suction cups 91 against the lower surface of the folded carton A. The carton is oriented with respect to the wall 21 of the head 12 and the suction cups 91 so that the ports 25, 26 and 27 of the head act only upon one large panel B on the upper surface of the carton blank while the suction cups act only upon one large panel C on the lower surface of the carton blank. The panels B and C, which are the front and back panels of the carton, are interconnected by side panels D. In the next stage of operation, the suction cups are connected to the high pressure vacuum source and the assembly 14 is moved downwardly as the head 12 remains stationary.

When the suction cups are touching the lower surface of the carton blank, the horizontal centerline of the cam followers 108 is positioned at the top of the central section 111 of the cam groove 107. As the suction cups move downwardly, they are also moved in an arc away from the magazine end of the machine so that the carton can partially unfold as shown in FIG. 6. At this point the roller 108 is at the top of the vertical section 109 of the cam groove and the head 12 is disconnected from the air exhauster 121 and vented to atmosphere by means of the air valve 119. The suction cups 91 continue to move downwardly, now vertically, drawing the folded carton A into the bucket 84. The engagement of the leading side panel D with the wall 87 of the bucket completes the erection of the carton. The suction cups are disconnected from the vacuum pump 122 and are vented to atmosphere by the appropriate air valve 120 as the panel C engages the floor 86 of the bucket. The conveyor is now actuated and moves the next bucket in the carton receiving position as the head moves toward the magazine 10 to pick off the next folded carton. The erected cartons are carried by the conveyor 13 to a loading station where groups of product (normally wrapped) are slid into the carton through one of the open ends. The end flaps of the cartons are subsequently folded and sealed to complete the packaging operation.

The large area suction ports in the wall 21 draw the cartons flat against that large flat wall 21 and hold the carton firmly with forces that are distributed fairly uniformly over the panel B of the folded carton. When a warped carton is picked off by the head it is drawn flat by the distributed suction forces allowing it to be easily opened. When the suction cups 91 move against the carton, the large flat wall 21 backs up the carton and insures that the suction cups properly grip the carton before moving away from the head. The combination of high vacuum at the suction cups 91 and uniformly distributed low vacuum at the head 12 results in easy opening of cartons which have been glued closed and cartons which have not been bent along all of the score lines during forming.

It will be seen from the foregoing that the present invention provides an improved machine for erecting cartons which routinely handles imperfect cartons without malfunction or adjustment.

We claim:

1. Apparatus for erecting folded cartons having first and second parallel panels comprising a magazine having an open end for storing flat folded and glued cartons, a vacuum head having a vacuum port area for engaging the major portion of said first panel, first vacuum exhauster means connected to said head for drawing air through said port at a low pressure of about 3 pounds per square inch and high flow rate of about 60 cubic feet per minute, means for conveying erected cartons to a loading station including an endless conveyor and a plurality of upwardly facing "U" shaped buckets, means for moving said head between a first position adjacent to the open end of said magazine and a second position adjacent said conveying means, said head being oriented in said first position with said port area facing and in close proximity to the open end of said magazine to draw a folded carton therefrom and being oriented in said second position with said port area facing said conveying means, carton opening means including a suction assembly on each side of said conveyor and frame members interconnecting said suction assemblies, the suction assemblies each including a pair of suction cups spaced along an edge of said conveyor and facing said head in said second position for engaging said second panel to grip said second panel at four widely spaced points, said suction cups engaging a total area on said second panel which is a minor portion of said second panel, second vacuum pump means connected to said opening means for drawing air through said suction cups at a high pressure of about 12 pounds per square inch and low flow rate of about 2 cubic feet per minute at each suction cup, means for moving said opening means toward said head in said second position to allow said suction cups to grip the folded carton carried by said head and moving said opening means away from said head to open said carton and place it in one of said buckets, and cam means for moving said suction assemblies along the longitudinal axis of said conveyor as they are moved between said head and said conveying means to aid in opening the carton, said cam means including a stationary vertically oriented cam track member on each side of said conveyor and a cam follower mounted on each of said suction assemblies.

2. Apparatus according to claim 1 wherein said head is a hollow box like member having its interior connected to said vacuum pump, said vacuum port area being formed in one wall of said box like member.

3. Apparatus according to claim 2 wherein said vacuum port area is formed by recesses provided in the outer surface of said one wall and aperatures connecting said recesses with the interior of said box like member.

* * * * *